US009483887B1

(12) United States Patent
Soleimani

(10) Patent No.: US 9,483,887 B1
(45) Date of Patent: Nov. 1, 2016

(54) HANDS-FREE ACCESS CONTROL

(71) Applicant: Kastle Systems International LLC, Falls Church, VA (US)

(72) Inventor: Mohammad Soleimani, Potomac, MD (US)

(73) Assignee: Kastle Systems International LLC, Falls Church, VA (US)

( * ) Notice: Subject to any disclaimer, the term of this patent is extended or adjusted under 35 U.S.C. 154(b) by 0 days.

(21) Appl. No.: 14/985,523

(22) Filed: Dec. 31, 2015

(51) Int. Cl.
*G07C 9/00* (2006.01)

(52) U.S. Cl.
CPC ..... *G07C 9/00007* (2013.01)

(58) Field of Classification Search
CPC ..... G07C 9/00309; G07C 2009/00507; G07C 2009/00769; G07C 2209/63; G07C 2009/00365
See application file for complete search history.

(56) References Cited

U.S. PATENT DOCUMENTS

2004/0000993 A1* 1/2004 Lu ..... A01M 31/002 340/539.1
2008/0180228 A1* 7/2008 Wakefield ..... G01S 5/0252 340/4.62
2014/0292481 A1* 10/2014 Dumas ..... G07C 9/00111 340/5.61
2015/0111552 A1* 4/2015 Kaye ..... H04M 3/56 455/416
2015/0235486 A1* 8/2015 Ellis ..... G07C 9/00309 340/5.61
2015/0379795 A1* 12/2015 Wu ..... G07C 9/00309 340/5.61
2016/0093130 A1* 3/2016 Shen ..... G07C 9/00174 340/5.61

* cited by examiner

*Primary Examiner* — Nabil Syed
(74) *Attorney, Agent, or Firm* — NovoTechIP International PLLC

(57) ABSTRACT

A method including receiving and storing a first signal strength threshold associated with obtaining access to a first access control device; receiving a first RF advertisement from the first access control device; obtaining a first received signal strength indication (RSSI) for the received first RF advertisement; determining that the first RSSI is greater than or equal to the first signal strength threshold; and transmitting, in response to the determination that the first RSSI is equal to or greater than the first signal strength threshold, a first RF message to indicate that the transmitting device is proximate to the first access control device.

16 Claims, 11 Drawing Sheets

HANDS-FREE ACCESS CONTROL

BACKGROUND

1. Field of the Disclosure

This disclosure pertains to access control systems and methods of providing more convenient access. More particularly, this disclosure pertains to such systems and methods which enable individuals to obtain access to secured area or resource using a wireless device, such as a smart phone.

2. Description of Related Art

Access control systems and methods restrict access to resources, areas and properties, allowing only privileged entities access. Conventionally, access control systems include an interconnected set of controllers, managing the entrance and exit of people through secure areas, with electronic key cards, and enable key/card administration without having to change locks. Controllers, readers and cards are indispensable components in known access control systems. Magnetic, optical and RFID technologies are used in connection with readers and key cards.

SUMMARY

In a general aspect, a method comprising receiving and storing a first signal strength threshold associated with obtaining access to a first access control device; receiving a first RF advertisement from the first access control device; obtaining a first received signal strength indication (RSSI) for the received first RF advertisement; determining that the first RSSI is greater than or equal to the first signal strength threshold; and transmitting, in response to the determination that the first RSSI is equal to or greater than the first signal strength threshold, a first RF message to indicate that the transmitting device is proximate to the first access control device.

Particular implementations may include one or more of the following features. The method may further comprise receiving and storing a second signal strength threshold associated with obtaining access to the first access control device, the second signal strength threshold being lower than the first signal threshold; scanning at a first scan rate for a second RF advertisement transmitted or broadcast by the first access control device; receiving the second RF advertisement message from the first access control device; obtaining a second RSSI for the second RF advertisement message; determining that the second RSSI is greater than or equal to the second signal strength threshold; and scanning, in response to the determination that the second RSSI is greater than or equal to the second signal strength threshold, at a second scan rate greater than the first scan rate for the first RF advertisement message.

The method may further comprise receiving and storing a first encryption key associated with the first access control device; and encrypting one or more portions of the first RF message based on the first encryption key prior to the transmitting of the first RF message.

The first RF message may indicate an approximate time of its transmission.

The method may further comprise providing a user interface for adjusting and storing a first user-specified sensitivity adjustment value in association with the first access control device; and in response to a second user-specified sensitivity adjustment value being stored in association with the first access control device and determining that the first RF advertisement is associated with the first access control device, adjusting the first RSSI or the first signal strength threshold based on the second user-specified sensitivity adjustment value.

The method may further comprise providing a user interface for adjusting and storing a global sensitivity adjustment value; and in response to the global sensitivity adjustment value being recorded, adjusting the first RSSI or the first signal strength threshold based on the global sensitivity adjustment value.

In a general aspect, a method comprising repeatedly transmitting an RF advertisement at a first amplitude, the RF advertisement indicating it is associated with a first access control device; receiving a first RF message indicating that a transmitting device is proximate to the first access control device; obtaining, after receiving the first RF message, an indication that a user has, at a distance of less than approximately 15 cm, interacted with the first access control device; and granting, in response to receiving the first RF message and the obtained indication, access to the first access control device.

Particular implementations may include one or more of the following features. The method may further comprise presenting, in response to receiving the first RF message, a visual or auditory indication that a user is expected to interact with the access control device at a distance of less than approximately 15 cm. The visual indication may include illuminating a portion of the access control device.

The method may further comprise capacitively sensing a portion of the user's body is at a distance of less than approximately 15 cm from the access control device.

In a general aspect, a nontransitory computer-readable medium including instructions which, when executed by one or more processors, cause the one or more processors to receive and store a first signal strength threshold associated with obtaining access to a first access control device; receive a first RF advertisement from the first access control device; obtain a first received signal strength indication (RSSI) for the received first RF advertisement; determine that the first RSSI is greater than or equal to the first signal strength threshold; and transmit, in response to the determination that the first RSSI is equal to or greater than the first signal strength threshold, a first RF message to indicate that the transmitting device is proximate to the first access control device.

Particular implementations may include one or more of the following features. The instructions may further cause the one or more processors to receive and store a second signal strength threshold associated with obtaining access to the first access control device, the second signal strength threshold being lower than the first signal threshold; scan at a first scan rate for a second RF advertisement transmitted or broadcast by the first access control device; receive the second RF advertisement message from the first access control device; obtain a second RSSI for the second RF advertisement message; determine that the second RSSI is greater than or equal to the second signal strength threshold; and scan, in response to the determination that the second RSSI is greater than or equal to the second signal strength threshold, at a second scan rate greater than the first scan rate for the first RF advertisement message.

The instructions further cause the one or more processors to: receive and store a first encryption key associated with the first access control device; and encrypt one or more portions of the first RF message based on the first encryption key prior to the transmitting of the first RF message.

The first RF message may indicate an approximate time of its transmission.

The instructions may further cause the one or more processors to provide a user interface for adjusting and storing a first user-specified sensitivity adjustment value in association with the first access control device; and in response to a second user-specified sensitivity adjustment value being stored in association with the first access control device and determining that the first RF advertisement is associated with the first access control device, adjust the first RSSI or the first signal strength threshold based on the second user-specified sensitivity adjustment value.

The instructions further may cause the one or more processors to provide a user interface for adjusting and storing a global sensitivity adjustment value; and in response to the global sensitivity adjustment value being recorded, adjust the first RSSI or the first signal strength threshold based on the global sensitivity adjustment value.

BRIEF DESCRIPTION OF THE DRAWINGS

The drawing figures depict one or more implementations in accord with the present teachings, by way of example only, not by way of limitation. In the figures, like reference numerals refer to the same or similar elements.

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

Figure 1:
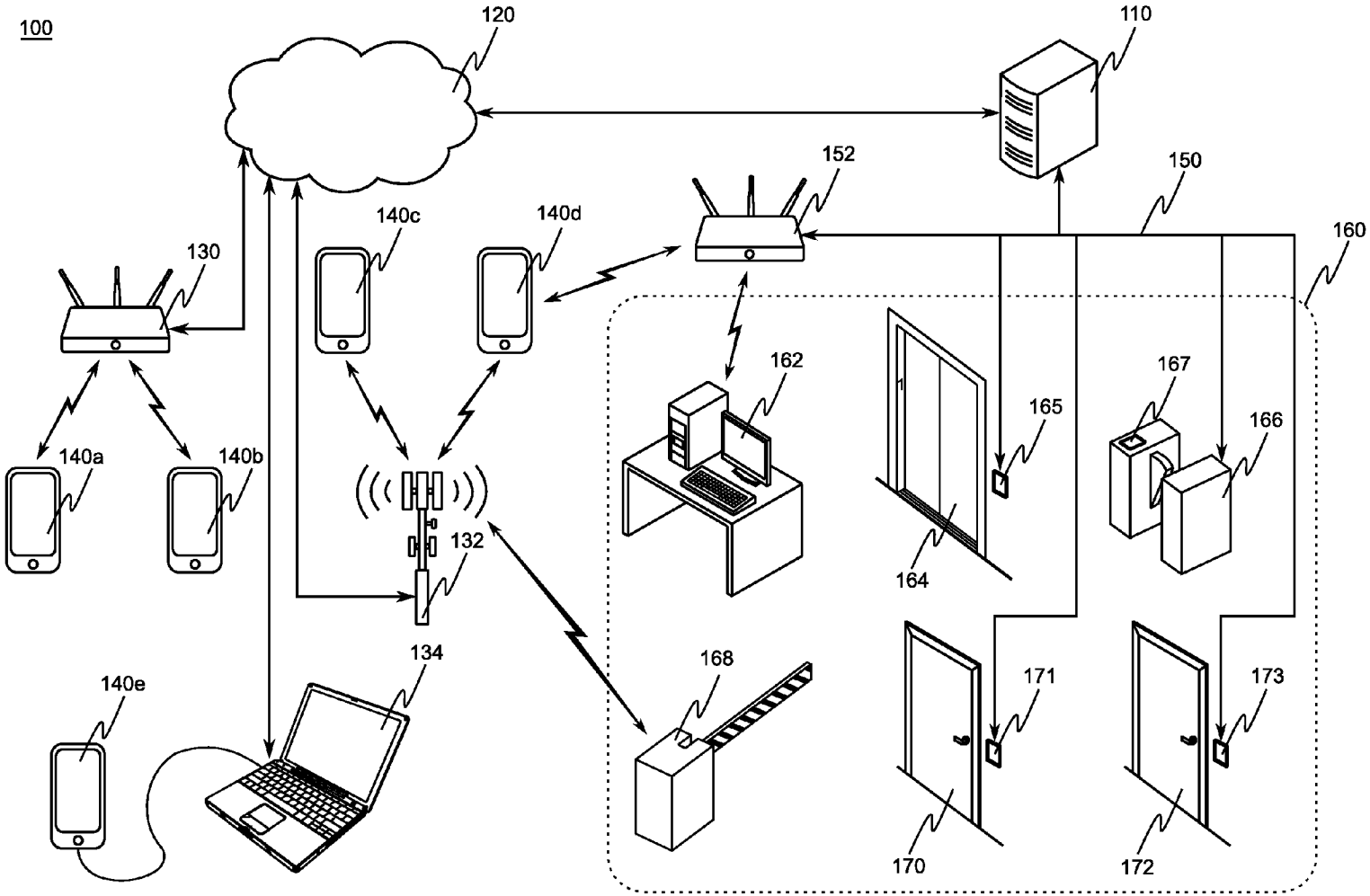
FIG. 1 illustrates an example of an access control system for obtaining access to secured areas or resources using wireless mobile devices.

FIG. 1 illustrates an example of an access control system 100 for obtaining access to secured areas or resources using wireless mobile devices 140*a*-140*e*. Access control system 100 includes access control server 110, which is configured to communicate with wireless mobile devices 140*a*-140*e* and access control devices 160. Although FIG. 1 illustrates a single computer system for access control server 110, access control server 110 may be implemented using multiple computer systems to divide functions across various computer systems, provide redundancy, and/or provide increased capacity, as deemed suitable for a particular implementation.

In the particular example illustrated in FIG. 1, access control server 110 is configured to communicate with wireless mobile devices 140*a*-140*e* via network 120, which may be a wide area network (WAN), such as, but not limited to, the Internet. In the particular example illustrated in FIG. 1, wireless mobile devices 140*a* and 140*b* are capable of communicating with access control server 110 via wireless router 130, which is configured to communicate via network 120; and wireless mobile devices 140*c* and 140*d* are capable of communicating with access control server 110 via cellular data network 132, which is configured to communicate via network 120. Computer system 134 is configured to communicate with access control server 110 via network 120, and is further configured to communicate with and configure wireless mobile device 140*e* via a connection between computer system 134 and wireless mobile device 140*e*, such as a Universal Serial Bus (USB) connection. In some implementations, computer 134 and wireless mobile device 140*e* may be configured to communicate with each other via a wireless communication protocol, such as Bluetooth. Each of wireless mobile devices 140*a*-140*e* may be implemented using, for example, a smartphone or smart watch device, such as, but not limited to, the Apple iPhone, the Apple iWatch, smartphones running the Android operating system, smart watches adapted for use with the Android operating system, and smart watches manufactured by Pebble. However, wireless mobile devices 140*a*-140*e* are not limited to such implementations. For example, wireless mobile device 140*e* may be implemented in a keyfob form factor without any user interface or user input elements for direct manipulation of wireless mobile device 140*e*.

In the particular example illustrated in FIG. 1, access control server 110 is configured to communicate with access control devices 160 (with the exception of vehicle barrier gate 168) via network 150. Each of the access control devices 160 controls access to a secured area or resource. Examples, of access control devices 160 include, but are not limited to, computer workstation 162, elevator 164 with a respective radio frequency (RF) communication unit 165 (which may be positioned adjacent to elevator 164 or within elevator 164), turnstile/gate 166 with a respective RF communication unit 167, vehicle barrier gate 168, secured door 170 with a respective RF communication unit 171, and secured door 172 with a respective RF communication unit 173. Each of the access control devices 160 may be configured to communicate via RF communication with wireless mobile devices 140*a*-140*e*, as discussed in more detail below. In the example illustrated in FIG. 1, access control server 110 communicates with elevator 164 and RF communication unit 165, turnstile/gate 166 and RF communication unit 167, secured door 170 and RF communication unit 171, and secured door 172 and RF communication unit 173 via wired network 150. Some or all of access control devices 160 may be configured to communicate with access control server 110 via a wireless communication network. FIG. 1 illustrates two such examples: computer workstation 162, which communicates with access control server 110 via wireless router 152 on network 150, and vehicle barrier gate 168, which communicates with access control server 110 via cellular communication network 132. Some or all of access control devices 160 may be configured to communicate with access control server 110 via one or more wireless mesh networks in which the access control devices 160 participate. Some or all of access control device 160 may be configured to communicate with access control server 110 via two or more networks. For example, in addition to cellular communication network 132, vehicle barrier gate 168 might also communicate with access control server 110 via network 150. Additionally, some or all of the wireless mobile devices 140*a*-140*e* may be configured to communicate with access control server 110 via network 150. FIG. 1 illustrates one such example: wireless mobile device 140*d*, which is capable of communicating with access control server 110 via wireless router 152.

Access control server 110 maintains records for the access control devices 160, approved wireless mobile devices 140*a*-140*e*, and which of the access control devices 160 may be accessed via each of the approved wireless mobile devices 140*a*-140*e*. In implementations in which encryption is used to secure communications between various components of system 100, such as between the wireless mobile devices 140*a*-140*e* and the access control devices 160 or between the access control devices 160 and access control server 110, access control server 110 may be configured to generate encryption keys and distribute the generated keys to the wireless mobile devices 140*a*-140*e* and/or the access control devices 160. Access control server 110 may also maintain a database of signal strength thresholds associated with the access control devices 160, and distribute the signal strength thresholds to wireless mobile devices 140*a*-140*c*. Access control server 110 may also be configured to maintain records of successful and/or unsuccessful interactions between wireless mobile devices 140*a*-140*e* and access control devices 160. For example, access control server 110 may record each time one of wireless mobile devices 140*a*-140*e* is used to successfully obtain access to secured areas or resources via access control devices 160, recording information such as, but not limited to, an identifier associated with a wireless mobile device and/or a user of the wireless mobile device, an identifier associated with a access control device, and a time of day and date of the access. Access control server 110 may store the above records in one or more databases.

Figure 2:
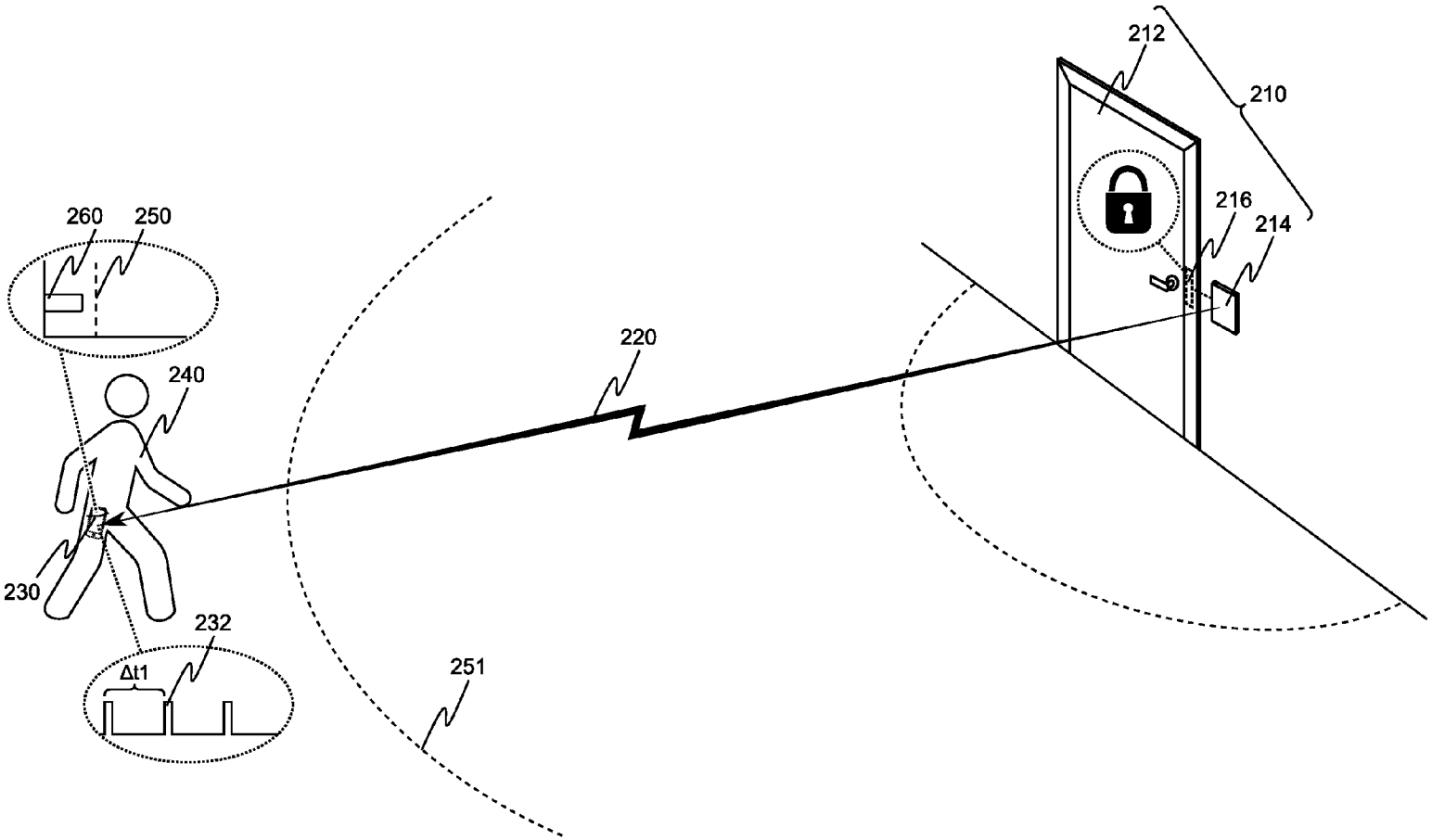
FIG. 2 illustrates an example of utilizing a wireless mobile device to obtain access to a secured area or resource via an access control device.

FIG. 2 illustrates an example of utilizing a wireless mobile device to obtain access to a secured area or resource via an access control device. In this particular example, access control device 210, comprising secured door 212, RF communication unit 214, and electronically actuated lock 216, controls access to a secured area beyond secured door 212. In other examples, different forms of access control devices, such as the various access control devices 160 illustrated in FIG. 1, may be used to control access to a secured area or resource in cooperation with suitably configured wireless mobile devices, such as wireless mobile device 230 illustrated in FIG. 2, which is configured for obtain access via access control device 210.

The RF communication unit 214 is installed proximal to the secured door 212. For example, the RF communication unit 214 may be affixed to a surface or structure defined by or proximal to the secured door 212. FIG. 2 illustrates a particular example in which RF communication unit 214 is embedded in an area of a wall adjacent to secured door 212. The precise positioning of RF communication unit 214 may be a matter of design choice, and in some implementations RF communication unit 214 may not be visible or accessible outside of the secured area to which secured door 212 provides access. A camera (not illustrated) may be installed proximal to an access control device to obtain images of individuals who have attempted or obtained access to a secured area or resource. The obtained images may be used for, for example, photographic or videographic documentation, or proximity detection.

Secured door 212 is equipped with an electronically actuated lock 216. This may be by way of a physical lock (such as a catch or solenoid) coupled to a networked lock actuator. For example, lock 216 may be unlocked by transmitting a control signal (from, for example, access control server 110 or RF communication unit 214) to a specified network address associated with lock 216. Lock 216 may include a physical lock that is coupled to an electronic door actuator. For example, RF communication unit 214 may be configured to provide a control signal to lock 216 via wiring between RF communication unit 214 and lock 216, and the control signal may be generated in response to an event generated by a processor included in RF communication unit 214 and/or a command received by RF communication unit 214 via a network such as network 150.

In the example illustrated in FIG. 2, RF communication unit 214 repeatedly transmits or broadcasts an RF advertisement 220. For example, RF communication unit 214 may repeatedly transmit RF advertisement 220 approximately every 100 milliseconds, although a lower advertisement rate, such as every 500 or 100 milliseconds, may be used. In some implementations, RF communication unit 214 may include a Bluetooth Low Energy (BLE) transmitter or transceiver, and RF communication unit 214 may be configured to operate in a BLE GAP (Generic Access Profile) Broadcaster or Central role in association with generating and transmitting or broadcasting RF advertisement message 220. In some implementations, RF communication unit 214 may be configured to transmit RF advertisement 220 in the a BLE beacon format, such as, but not limited to, Eddystone or iBeacon, in which the advertisement includes a UUID (universally unique identifier) and/or, in some embodiments, other data which identifies access control device 210 in which RF communication unit 214 is included. In some implementations, RF communication unit 214 may include an 802.11 wireless network transmitter or transceiver configured to transmit RF advertisement 220; for example, a periodic broadcast indicating an SSID and/or BSSID may provide RF advertisement 220. In some implementations, RF communication unit 214 may include an RFID or NFC transmitter or transceiver effective for communicating with wireless mobile device 230 at a distance of at least 2, 4, 6, 8, or 10 meters from RF communication unit 214, and configured to transmit RF advertisement 220. Each transmission of RF advertisement 220 by RF communication unit 214 may be at a first amplitude, and the first amplitude may be selectively set to a desired level, such as 0 dBm, by, for example, access control server 110. In some implementations, RF communication units in proximity to each other, such as RF communication units 171 and 173 illustrated in FIG. 1, may be configured to transmit or broadcast respective RF advertisements at different times to avoid RF signal collisions or contention. In some implementations, neighboring RF communication units, such as RF communication units 171 and 173 illustrated in FIG. 1, may be configured to utilize different channels or RF frequencies to avoid RF signal collisions or contention.

RF advertisement 220 may be a packet or message that encodes information including, for example, an identifier associated with access control device 210, an identifier associated with a secured area or resource controlled by access control device 210, an identifier associated with a facility, network, or organization associated with access control device 210, an identifier associated with a vendor or manufacturer of RF communication unit 214, an indication of a current time and/or date, one or more functions that may be performed by access control device 210 (such as, for example, unlocking secured door 212), an indication of whether secured door 212 is currently locked, one or more signal strength threshold values (such as first signal strength threshold 250 discussed below), or an indication whether secured door 212 is currently open. One or more portions of the information encoded in RF advertisement 220 may be encrypted. The encrypted portions may be decrypted by wireless mobile device 230 using, for example, a key associated with access control device 210, a key associated with wireless mobile device 230, a key associated with a user of wireless mobile device 230, or a key associated with a facility, network, or organization associated with access control device 210. In some implementations, RF communication unit 214 may be configured to continuously transmit an RF advertisement 220 or other RF signal, although this may result in wireless mobile device 230 having increased power consumption in order to process the continuous transmission.

Wireless mobile device 230 is configured to detect RF advertisement 220. For example, wireless mobile device 230 may include an RF receiver or transceiver capable of detecting or receiving RF advertisement 220. In some implementations, wireless mobile device 230 may be configured to utilize location information, such as information obtained via satellite navigation systems (such as, but not limited to, GPS, GLONASS, Galileo, or QZSS), RF advertisements transmitted by access control devices 160, or identifying information broadcast by nearby wireless networking devices (such as, but not limited, to BSSID or SSID information), to enable or disable detection of such RF advertisements in order to reduce power consumption or improve security. Location information for wireless mobile device 230 or user 240 may also be detected by devices outside of wireless mobile device 230, and such location information may be obtained by wireless mobile device 230 or used elsewhere in access control system 100; for example, user 240 logging into a computer workstation, detection of a license plate for a vehicle associated with user 240, use of another access control service such as a parking garage, and association of wireless mobile device 230 with a wireless access point or Bluetooth device may each provide location information. Items of location information may also have associated times, such as a time at which the location information was obtained or collected. Wireless mobile device 230 may also be configured to obtain a received signal strength indicator (RSSI) 260 for the detected RF advertisement 220. RSSI 260 may be determined based on a plurality of RSSI measurements, such as, but not limited to, an average or a running average of RSSI measurements obtained for a plurality of RF advertisement messages 220.

In some implementations, wireless mobile device 230 may be configured to scan for RF advertisement messages 220 during periods 232 at approximately a first scan rate, illustrated by the time $\Delta t1$ in FIG. 2. For example, time $\Delta t1$ might be approximately 1000 or 5000 milliseconds. In some implementations, wireless mobile device 230 may be configured to enable detecting, receiving, or processing RF advertisement messages 220 during periods 232, and disable detecting, receiving, or processing RF advertisement messages 220 between reception periods 232. In some implementations, an RF receiver may be enabled at the beginning of period 232 and disabled at the end of period 232. In some implementations, an operating system executing on wireless mobile device 230 may be instructed to enable detecting, receiving, or processing RF advertisement messages 220 at the beginning of period 232 and to disable detecting, receiving, or processing advertisement messages 220 at the end of period 232. The beginning of a period 232 may be based on a time at which an RF advertisement message 220 was received, so as to synchronize period 232 with an expected time of transmission of a later RF advertisement message 220. Period 232 may be terminated in response to the successful detection, reception, or processing of an RF advertisement message 220.

In some implementations, wireless mobile device 230 may include a BLE receiver or transceiver that is effective for detecting and receiving RF advertisement message 220 transmitted by a BLE transmitter or transceiver included in RF communication unit 214. Wireless mobile device 230 may include a BLE receiver or transceiver, and wireless mobile device 230 may be configured to operate in a BLE GAP Observer or Peripheral role in association with receiving and processing RF advertisement message 220. Wireless mobile device 230 may be configured such that an operating system executing on wireless mobile device 230 launches an app or application program on wireless mobile device 230 (in the event that the app or application program is not already active) and/or notifies the app or application program in response to RF advertisement message 220 being received. The notification may include or be accompanied with RSSI 260 for the received or detected RF advertisement message 220.

Wireless mobile device 230 may determine whether RSSI 260 is greater than or equal to a first signal strength threshold 250, which corresponds approximately to a first distance from RF communication unit 214 (as various factors, such as, but not limited to, multipath effects or receiver orientation, may result in RSSI 260 only approximately corresponding to a distance between wireless mobile device 230 and RF communication unit 214), which is illustrated by a first distance circle 251 in FIG. 2. First distance circle 251 (as well as distance circles 253, 823, 1010, 1012, and 1014 in later figures) are merely for illustration to relate a corresponding RSSI threshold to an approximate distance from an access control device. In the particular example illustrated in FIG. 2, although a user 240 carrying wireless mobile device 230 (such as in a pocket or a purse, for example) is walking toward RF communication unit 214, RSSI 260 is less than the first signal strength threshold 250 (as illustrated by the graph in FIG. 2), and accordingly user 240 remains outside of first distance circle 251. In some implementations, RSSI 260 may be provided by wireless mobile device 230 to RF communication unit 214 or access control server 110, which then performs a comparison of RSSI 260 against first signal strength threshold 250.

Adjustments may be made to RSSI 260 or the first signal strength threshold 250 before determining whether RSSI 260 is greater than or equal to first signal strength threshold 250. Similar adjustments may be made for RSSI 260 and the signal strength thresholds illustrated in FIGS. 3-8. Different models of wireless mobile devices may demonstrate different sensitivities. For example, at a distance of 4 meters from RF communication unit 210, a first model might measure an RSSI of −65 dBm, whereas a second model might instead measure an RSSI of −70 dBm (indicating the second model is less sensitive). An adjustment of 5 dBm may be applied to normalize the sensitivities of the two models, by, for example, applying the adjustment to RSSI 260 or to first signal strength threshold 250. A database may be maintained, by, for example, access control server 110 or an app or application on wireless mobile device 230, to store and provide model-specific adjustment values, and measurements may be collected for new models (such as via an app or application executing on wireless mobile device 230) to determine associated adjustment values for inclusion in the database. Additionally, individual wireless mobile devices, even if they are the same model, may demonstrate different sensitivities. For example, at a distance of 4 meters from RF communication unit 210, a first wireless mobile device might measure an RSSI of −65 dBm, whereas a second wireless mobile device might measure an RSSI of −67 dBm (indicating the second wireless mobile device is less sensitive). An adjustment of 2 dBm may be applied to normalize the sensitivities of individual devices, by, for example, applying the adjustment to RSSI 260 or to first signal strength threshold 250. Wireless mobile device 230 or access control server 110 may store device-specific adjustment values, and measurements may be collected (such as via an app or application executing on wireless mobile device 230) to generate per-device adjustment values.

Wireless mobile device 230 may be configured to determine when it is, for example, in a pocket, in a purse, or is being used to conduct a telephone call, each of which may have an effect on a sensitivity of an RF receiver included in wireless mobile device 230. Temperature, orientation, light sensor or camera, proximity detector, cover closure detector, IMU (detecting movement associated with user 240 walking), time of day, day of week, calendar, past history of user activities, and whether a phone call is currently being conducted may be considered in determining whether wireless mobile device 230 is in a pocket, in a purse, or being used to conduct a telephone call. Emiliano Miluzzo, Michela Papandrea, Nicholas D. Lane, Hong Lu, and Andrew T. Campbell. "Pocket, Bag, Hand, etc.—Automatically Detecting Phone Context through Discovery." *Proc. PhoneSense* 2010 (2010): 21-25, which is incorporated herein by reference in its entirety, describes techniques which may be used to identify, for example, when a wireless mobile device is located in a purse or pocket. In response to determining when it is in a pocket, in a purse, or is being used to conduct a telephone call, a corresponding adjustment value may be determined and applied, by, for example, applying the adjustment value to RSSI 260 or to first signal strength threshold 250.

The user 240 of wireless mobile device 230 may be able to specify a sensitivity adjustment value. For example, user 240 may specify a global adjustment value to adjust the sensitivity for all access control devices. As another example, user 240 may specify an adjustment value for individual access control devices, and the adjustment value for the specific access control device may take precedence over, or be used in combination with, a global adjustment value. An adjustment value for an individual access control device may be utilized in response to determining an RF advertisement is, or likely is, associated with the individual access control device. Such adjustment values may be specified via an interface provided by wireless mobile device 230, or may be specified via access control server 110. The use of user-specified adjustment values is discussed in more detail below with regard to FIG. 10.

Wireless mobile device 230 may be configured to obtain and analyze movement information. For example, wireless mobile device 230 may include an inertial measurement unit (IMU) configured to measure, for example, acceleration or rotation of wireless mobile device 230. Movement information obtained via the IMU may be used to determine that wireless mobile device 230 is in motion, or recently was in motion, as would be expected in connection with user 240 approaching access control device 210. Wireless mobile device 230 may be configured to not perform or disable various operations (for example, disabling a receiver or not responding to RF advertisements 220) when not moving, in order to prevent relay attacks and/or reduce power consumption. Additionally, the movement information may be compared against a per-user gait signature registered for user 240, as discussed in, for example, U.S. Patent App. Pub. No. 2008/0175443, which is incorporated herein by reference in its entirety. In response to the movement information not sufficiently corresponding to the gait signature, wireless mobile device 230 may not perform or disable various operations. Both movement information and location information may be used together; for example, a GPS location at or near a facility along with a determination that wireless mobile device 230 is in motion may result in certain operations being enabled. Movement information may also be obtained based on location information that has been collected over time. For example, movement of wireless mobile device 230 through a facility or at locations a significant distance away from a facility may be considered.

Figure 3:
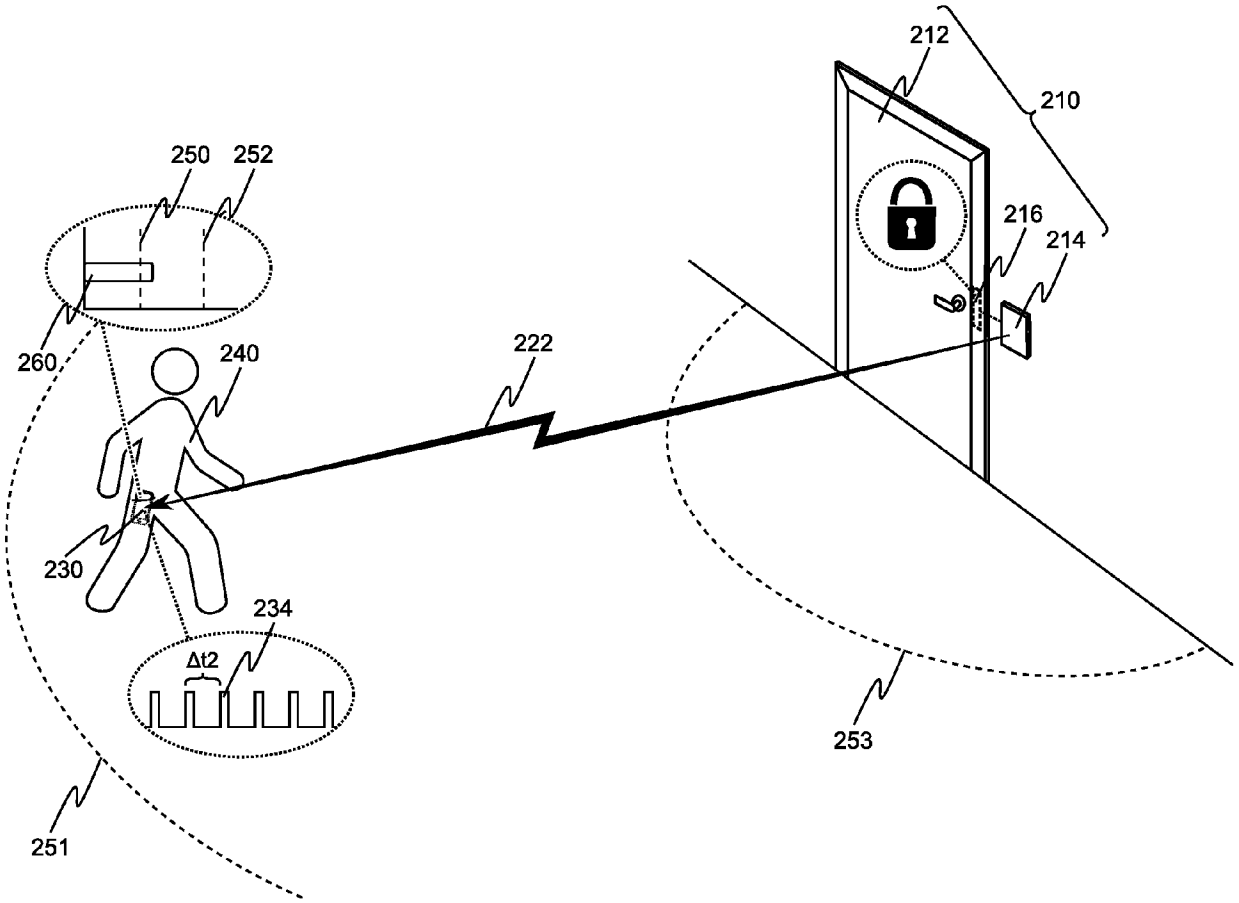
FIG. 3 illustrates an example that continues the example illustrated in FIG. 2.

FIG. 3 illustrates an example that continues the example illustrated in FIG. 2. In FIG. 3, user 240 has moved closer to RF communication device 214, RSSI 260 is greater than first signal strength threshold 250, and user 240 is accordingly now positioned within first distance circle 251. Wireless mobile device 230 may determine that RSSI 260 is equal to or greater than first signal strength threshold 250. In some implementations, wireless mobile device 230 may provide RSSI 260 to another device, such as access control server 110 or RF communication unit 214, which determines whether RSSI 260 is equal to or greater than first signal strength threshold 250. In some implementations, RSSI 260 may have to be equal to or greater than first signal strength threshold 250 a predetermined plural number of times (for example, RSSI 260 may need to be equal to or greater than first signal strength threshold 250 three times in a row).

In response to RSSI 260 being equal to or greater than first signal strength threshold 250, wireless mobile device 230 or other aspects of access control system 100 may perform certain operations. However, much as discussed above, other information may be considered in determining to perform such operations. As a first example, current or recent location information may be considered to ensure that wireless mobile device 230 is actually in proximity to access control device 160. The location information may be based on determining whether wireless mobile device 230 is, or recently was, in proximity to other access control devices 160. For example, if secured doors 170 and 172 are located near each other, RF advertisements should be received from both RF communication units 171 and 173. As a second example, motion information may be considered to determine that wireless mobile device 230 is, or recently was, in motion. By considering such other information, relay attacks may be identified, prevented, or defeated.

In response to RSSI 260 being equal to or greater than first signal strength threshold 250, wireless mobile device 230 may provide an indication of its proximity to access control device 210 to access control server 110 or RF communication unit 230. One or more portions of the provided indication may be encrypted. Alternatively or in addition, the indication may be recorded in a memory included in wireless mobile device 230.

In response to RSSI 260 being equal to or greater than first signal strength threshold 250, wireless mobile device 230 may be configured to scan for RF advertisement messages 222 during periods 234 at approximately a second scan rate, illustrated by the time Δt2 in FIG. 3, that is greater than the first scan rate corresponding to time Δt1 for RF advertisement 220 illustrated in FIG. 2 and discussed above. For example, time Δt2 might be approximately 200, 500, or 1000 milliseconds. By using a higher frequency for periods 234, wireless mobile device 230 may more frequently compare RSSI 260 with second signal strength threshold 252, which is discussed in more detail below. In some implementations, wireless mobile device 230 may be configured to enable detecting, receiving, or processing RF advertisement messages 220 during periods 234, and disable detecting, receiving, or processing RF advertisement messages 220 between reception periods 234. In some implementations, an RF receiver may be enabled at the beginning of period 234 and disabled at the end of period 234. In some implementations, an operating system executing on wireless mobile device 230 may be instructed to enable detecting, receiving, or processing RF advertisement messages 222 at the beginning of period 234 and to disable detecting, receiving, or processing advertisement messages 222 at the end of period 234. The beginning of a period 234 may be based on a time at which an RF advertisement message 222 was received, so as to synchronize period 234 with an expected time of transmission of a later RF advertisement message 222. Period 234 may be terminated in response to the successful detection, reception, or processing of an RF advertisement message 222.

RF advertisement 222 may be provided by RF communication unit 214 in various ways. In a first example, RF communication unit 214 may be configured to transmit or broadcast RF advertisements 220 and 222 on separate RF channels, and wireless mobile device 230 may be configured to change an RF channel on which it is listening for RF signals. In a second example, a second RF communication unit (not illustrated) may be configured to transmit or broadcast RF advertisements 222. In a third example, RF advertisements 222 may simply be provided by RF advertisements 220. In a third example, RF communication unit may include a BLE transmitter or transceiver, and be configured to operate in a BLE GAP Broadcaster or Peripheral role in which it broadcasts RF advertisements 220 and 222 indicating different UUIDs.

RF advertisement 222 may be a packet or message that encodes information including, for example, an identifier associated with access control device 210, an identifier associated with a secured area or resource controlled by access control device 210, an identifier associated with a facility, network, or organization associated with access control device 210, an identifier associated with a vendor or manufacturer of RF communication unit 214, an indication of a current time and/or date, one or more functions that may be performed by access control device 210 (such as, for example, unlocking secured door 212), an indication of whether secured door 212 is currently locked, one or more signal strength threshold values (such as first signal strength threshold 250 discussed below), or an indication whether secured door 212 is currently open. One or more portions of the information encoded in RF advertisement 222 may be encrypted. The encrypted portions may be decrypted by wireless mobile device 230 using, for example, a key associated with access control device 210, a key associated with wireless mobile device 230, a key associated with a user of wireless mobile device 230, or a key associated with a facility, network, or organization associated with access control device 210.

In response to RSSI 260 being equal to or greater than first signal strength threshold 250, wireless mobile device 230 may determine whether RSSI 260 is greater than or equal to a second signal strength threshold 252, which corresponds approximately to a second distance from RF communication unit 214, which is illustrated by a second distance circle 253 in FIG. 3. Second signal strength threshold 252 is greater than first signal strength threshold 250, as illustrated in the graph included in FIG. 3, and correspondingly second distance circle 253 is closer to RF communication unit 214 than first distance circle 251. In the particular example illustrated in FIG. 3, although the user 240 carrying wireless mobile device 230 is continuing to walk toward RF communication unit 214, RSSI 260 is less than the second signal strength threshold 250 (as illustrated by the graph in FIG. 3), and accordingly user 240 remains outside of second distance circle 253.

Figure 4:
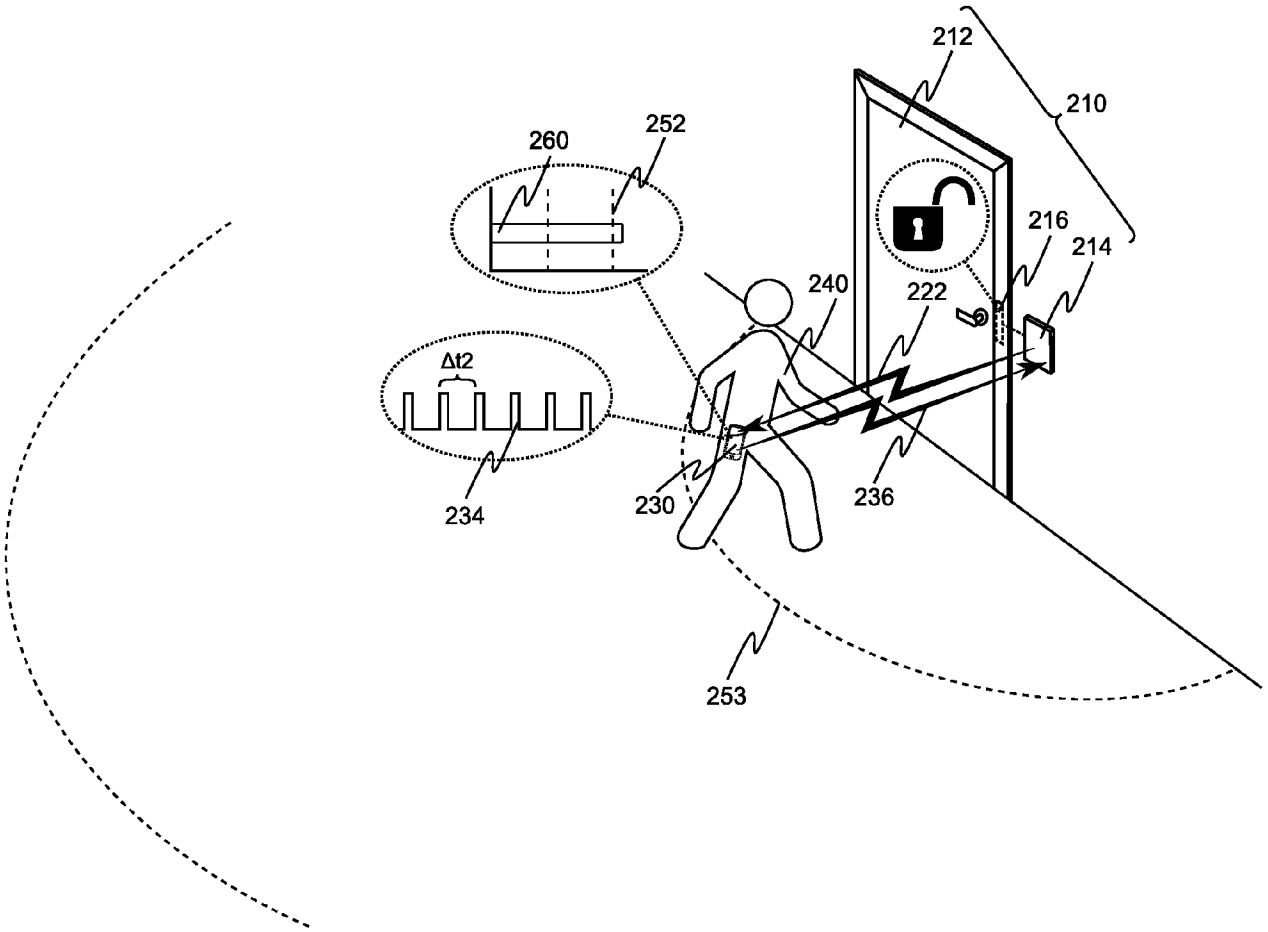
FIG. 4 illustrates an example that continues the examples illustrated in FIGS. 2 and 3.

FIG. 4 illustrates an example that continues the examples illustrated in FIGS. 2 and 3. In FIG. 4, user 240 has moved closer to RF communication device 214, RSSI 260 is greater than second signal strength threshold 252 (as illustrated by the graph in FIG. 4), and user 240 is accordingly now positioned within second distance circle 253. Wireless mobile device 230 may determine that RSSI 260 is equal to or greater than second signal strength threshold 252. In some implementations, wireless mobile device 230 may provide RSSI 260 to another device, such as access control server 110 or RF communication unit 214, which determines whether RSSI 260 is equal to or greater than second signal strength threshold 252. In some implementations, RSSI 260 may have to be equal to or greater than second signal strength threshold 252 a predetermined plural number of times (for example, RSSI 260 may need to be equal to or greater than second signal strength threshold 252 three times in a row).

In response to RSSI 260 being equal to or greater than second signal strength threshold 252, wireless mobile device 230 or other aspects of access control system 100 may perform certain operations. However, much as discussed above, other information may be considered in determining whether to perform such operations. As a first example, current or recent location information may be considered to ensure that wireless mobile device 230 is actually in proximity to access control device 160. The location information may be based on determining whether wireless mobile device 230 is, or recently was, in proximity to other access control devices 160. For example, of secured doors 170 and 172 are located near each other, RF advertisements should be received from both RF communication units 171 and 173. As a second example, motion information may be considered to determine that wireless mobile device 230 is, or recently was, in motion. By considering such other information, relay attacks may be identified, prevented, or defeated.

In response to RSSI 260 being equal to or greater than second signal strength threshold 252, wireless mobile device 230 may transmit message 236 to RF communication unit 214, such as via an RF transmission by wireless mobile device 230 that is received by a receiver or transceiver included in RF communication unit 214. In some implementations, message 236 may be transmitted via BLE GATT (Generic Attribute Profile), in addition to other messages exchanged between wireless mobile device 230 and RF communication unit 214. In some implementations, wireless mobile device 230 may, alternatively or in addition, transmit message 236 to access control server 110, such as via cellular data network 132 or via wireless router 152, and access control server 110 may process message 236 much as discussed below. Wireless mobile device 230 may be configured to encrypt one or more portions of message 236 using, for example, a key associated with access control device 210, a key associated with wireless mobile device 230, a key associated with a user of wireless mobile device 230, or a key associated with a facility, network, or organization associated with access control device 210. Message 236 may encode information including, for example, an identifier associated with access control device 210, an indication of a current time and/or date, an identifier associated with user 240, an identifier associated with wireless mobile device 230, an identifier associated with a secured area or resource controlled by access control device 210, a function to be performed by access control device 210, and/or RSSI 260.

RF communication unit 214 or access control server 110 may perform validation of message 236, and determine whether access should be granted to the secured area or resource controlled by access control device 210. In some implementations, a portion of message 236 may be decrypted using a key unique to access control device 210, and access may be granted in response to successful decryption of the portion using the unique key or the decrypted data having a particular value or characteristics. In some implementations, access may be granted in response to access control server 110 determining, based on information included in message 236, that access should be granted. For example, access control server 110 may maintain a database indicating which users or wireless mobile devices should be granted access to the various access control devices 160 being managed by access control server 110, and determine whether user 240 should be granted access to access control device 210 based on the information stored in the database. The determination whether access should be granted may also be based on a date or time of day. For example, certain users or wireless mobile devices may be not be granted access on weekends or during the night, but may be granted access at other times. The determination whether access should be granted may be based on an electronic calendar associated with user 240 or a secured area or resource. For example, access to a secured area or resource may be based on user 240 having an associated event included in an electronic calendar. As another example, access to a secured area or resource may be denied if the electronic calendar indicates user 240 is on vacation.

In response to determining that access should be granted via access control device 210, electronically actuated lock 216 is unlocked (as indicated by the unlocked icon in FIG. 4) to allow user 240 to proceed through secured door 212. In some implementations, secured door 212 may also automatically open and close. As discussed above, unlocking of lock 216 may occur in response to a signal received by lock 216 via a network from access control server 110 or RF communication unit 214, or may occur in response to a control signal provided by RF communication unit 214. Access control device 210 may be configured to detect when secured door 212 is opened and closed, and lock 216 may be locked in response to secured door 212 being closed.

Figure 5:
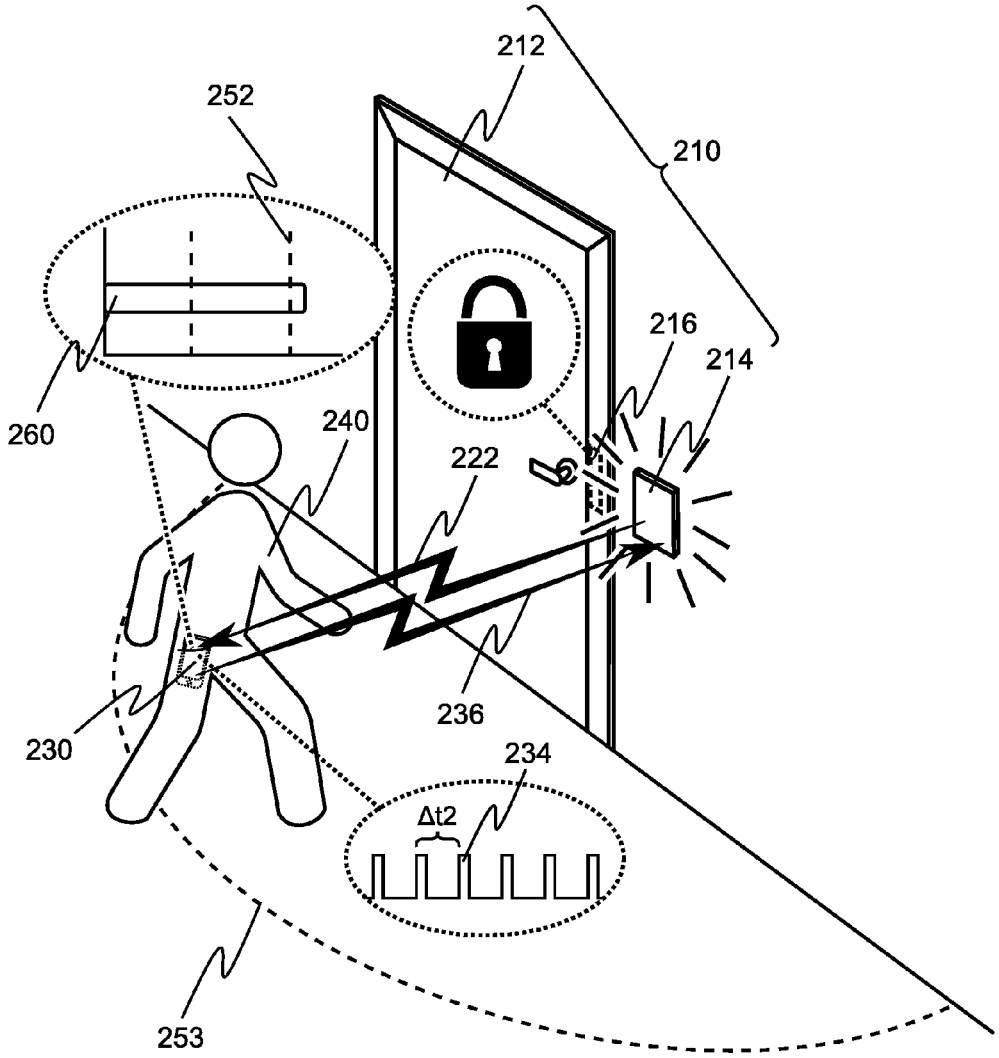
FIG. 5 illustrates an alternative example that continues the examples illustrated in FIGS. 2 and 3.

FIG. 5 illustrates an alternative example that continues the examples illustrated in FIGS. 2 and 3. Interaction between wireless mobile device 230 and access control device 210 may proceed much as described above with respect to FIG. 4. However, although RSSI 260 is equal to or greater than second signal strength threshold 252 (as illustrated by the graph in FIG. 5), access control unit 210 remains locked (as illustrated by the locked icon in FIG. 5). Rather than granting access to the secured area or resource controlled by access control device 210, access control device 210 provides an indication to user 240 that further interaction is required for user 240 to be granted access.

In FIG. 5, and much as discussed above with respect to FIG. 4, user 240 has moved closer to RF communication device 214, RSSI 260 is greater than second signal strength threshold 252, and user 240 is accordingly now positioned within second distance circle 253. Wireless mobile device 230 may determine that RSSI 260 is equal to or greater than second signal strength threshold 252. In some implementations, wireless mobile device 230 may provide RSSI 260 to another device, such as access control server 110 or RF communication unit 214, which determines whether RSSI 260 is equal to or greater than second signal strength threshold 252. In some implementations, RSSI 260 may have to be equal to or greater than second signal strength threshold 252 a predetermined plural number of times (for example, RSSI 260 may need to be equal to or greater than second signal strength threshold 252 three times in a row). As discussed above with respect to FIG. 4, in response to RSSI 260 being equal to or greater than second signal strength threshold 252, wireless mobile device 230 or other aspects of access control system 100 may perform certain operations, and other information may be considered in determining whether to perform such operations.

In response to RSSI 260 being equal to or greater than second signal strength threshold 252, wireless mobile device 230 may transmit message 236 to RF communication unit 214, or may transmit message 236 to access control server 110, much as discussed above with respect to FIG. 4. RF communication unit 214 or access control server 110 may perform validation of message 236, and determine whether access should be granted to the secured area or resource controlled by access control device 210, much as discussed above with respect to FIG. 4.

As noted above, rather than unlock secured door 212, an indication may be provided to user 240 that further interaction with access control device 210 is required to be granted access. The indication may include a visual indication, such as, but not limited to, causing RF communication unit 214 or another portion of access control device 210 to be illuminated (either as a steady illumination or blinking), or causing a display unit included in access control device 210 to display an appropriate message (such as, for example, "WAVE HAND IN FRONT OF RECEIVER FOR ACCESS" or "PLACE PHONE ADJACENT TO RECEIVER"). The indication may include an audio indication, such as, but not limited to, generating a sound such as a beep via an audio transducer or speaker included in access control device 210. The indication may include an audio indication, such as, but not limited to, generating a sound such as a beep via an audio transducer or speaker included in wireless mobile device 230. In some implementations, wireless mobile device 230 may be configured to automatically provide an audio indication in response to wireless mobile device 230 determining that RSSI 260 is equal to or greater than second signal strength threshold 252.

Figure 6:
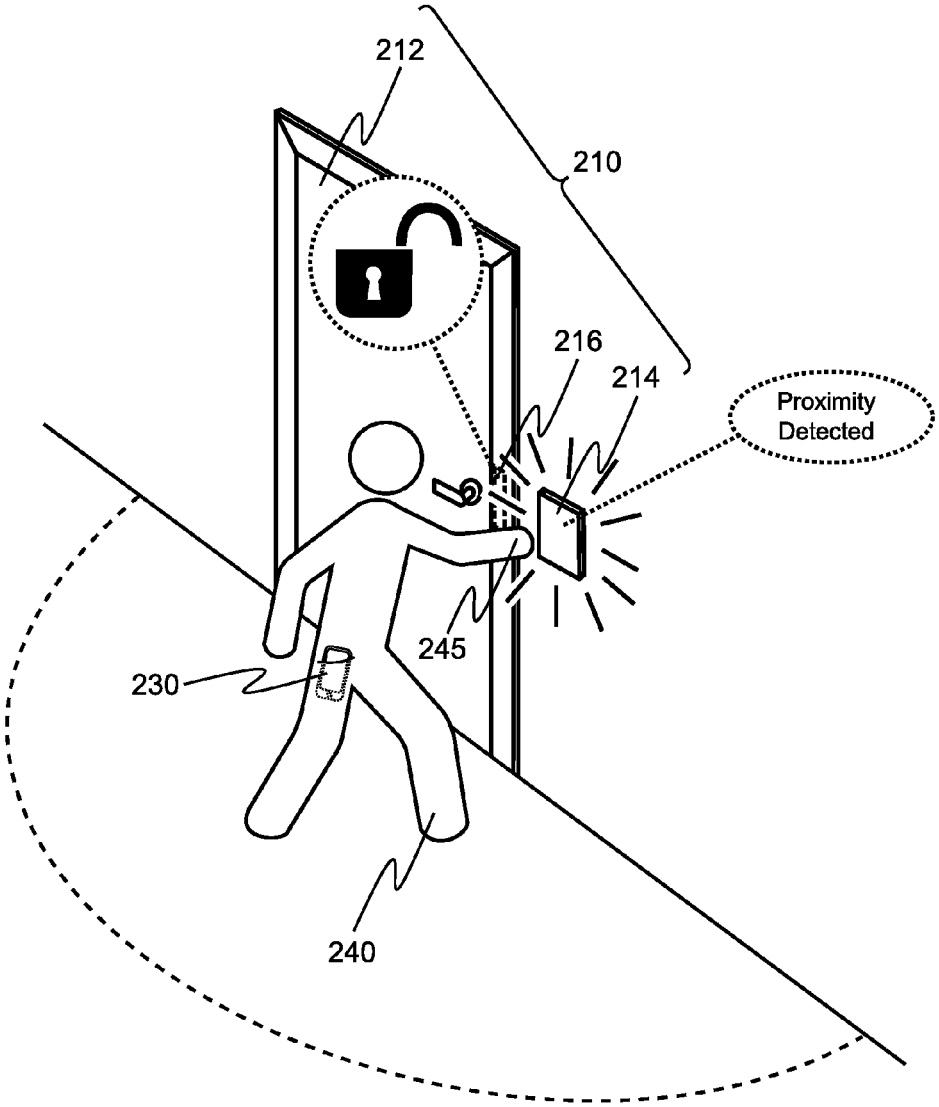
FIG. 6 illustrates an example that continues the example illustrated in FIG. 5.

FIG. 6 illustrates an example that continues the example illustrated in FIG. 5. In the example illustrated in FIG. 6, user 240 may be granted access via access control device 210 in response to user 240, or a part of user 240 such as hand 245, coming within range of a proximity detector included in access control device 210, such as, but not limited to, a proximity detector included in RF communication unit 214. Much as discussed above with respect to FIG. 5, RF communication unit 214 may be illuminated in response to wireless mobile device 230 having approached access control device 210 and provided an indication of its approach via message 226. In some implementations, the proximity detector may be temporarily activated, and RF communication unit 214 illuminated while the proximity detector is active, in response to the message 226 being received from wireless mobile device 230 in response to RSSI 260 being equal to or greater than second signal strength threshold 252. The proximity detector may be configured to indicate that user 240 has interacted with the proximity detector at a distance of less than approximately 5 centimeters. The proximity detector may be configured to indicate that user 240 has interacted with the proximity detector at a distance of less than approximately 10 centimeters. The proximity detector may be configured to indicate that user 240 has interacted with the proximity detector at a distance of less than approximately 15 centimeters. The proximity detector may be configured to indicate that user 240 has interacted with the proximity detector at a distance of less than approximately 30 centimeters. The proximity detector may be configured to indicate that user 240 has physically touched the proximity detector. The proximity sensor may include, for example, a capacitive sensor, an optical sensor, an ultrasonic sensor, an infrared sensor, or a touch sensor. An indication that user 240 or a portion of user 240 has come within sufficient proximity of the proximity sensor may be provided to RF communication unit 214 or access control server, which may then cause secure door 212 to be unlocked, as discussed above.

Figure 7:
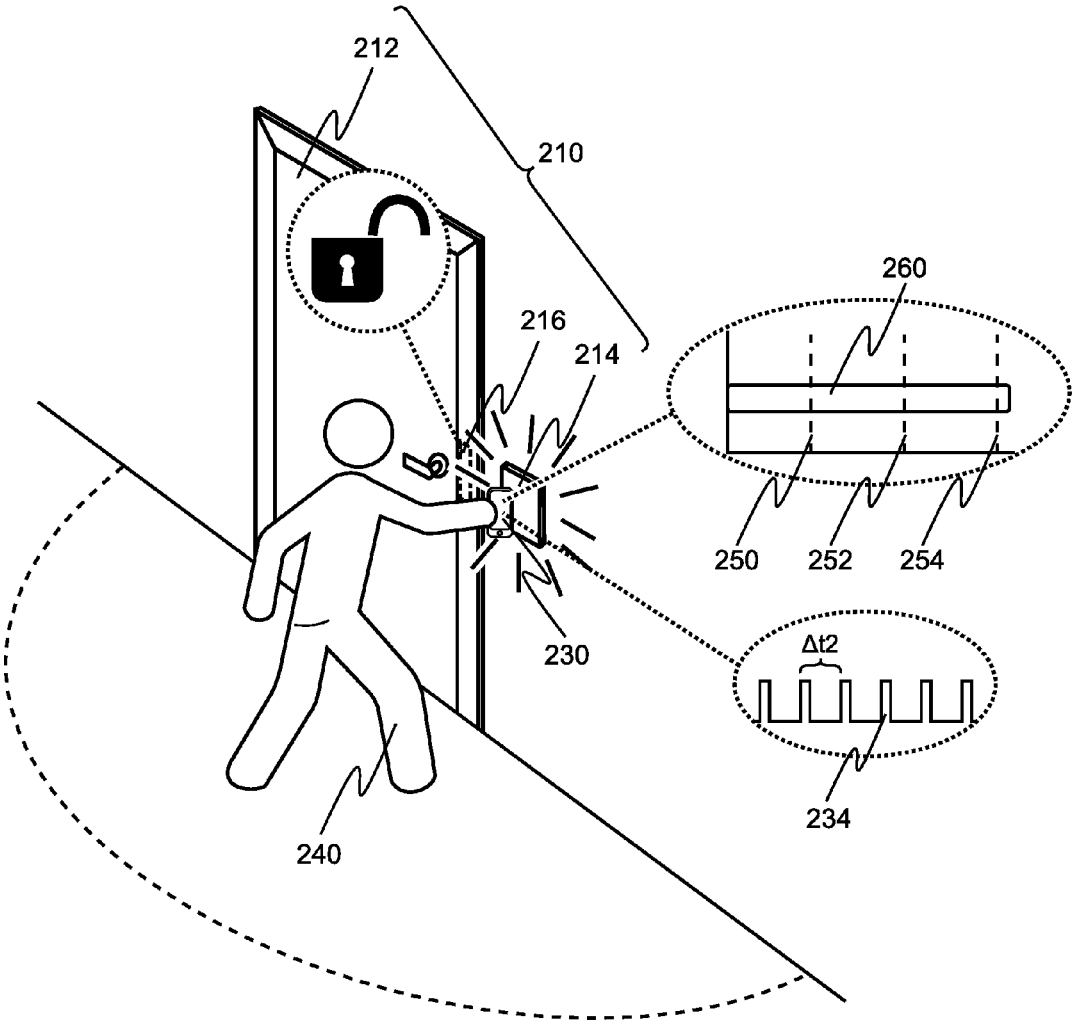
FIG. 7 illustrates an alternative example that continues the example illustrated in FIG. 5.

FIG. 7 illustrates an alternative example that continues the example illustrated in FIG. 5. In the example illustrated in FIG. 7, access may be granted based on wireless mobile device 230 being brought into close proximity to RF communication unit 214, such that RSSI 260 is equal to or greater than a third signal strength threshold 254. Third signal strength threshold 254 is greater than second signal strength threshold 252, as illustrated in the graph included in FIG. 7. Third signal strength threshold 254 may correspond to wireless mobile device 230 being within 5 centimeters of RF communication unit 214. Third signal strength threshold 254 may correspond to wireless mobile device 230 being within 10 centimeters of RF communication unit 214. Third signal strength threshold 254 may correspond to wireless mobile device 230 being within 15 centimeters of RF communication unit 214. Third signal strength threshold 254 may correspond to wireless mobile device 230 being within 20 centimeters of RF communication unit 214. Third signal strength threshold 254 may correspond to wireless mobile device 230 being within 30 centimeters of RF communication unit 214.

Much as discussed above with respect to FIG. 5, RF communication unit 214 may be illuminated in response to wireless mobile device 230 having approached access control device 210 and provided an indication of its approach via message 236. Subsequent to access control server 110 or RF communication unit 214 receiving message 236, RF communication unit 214 may continue transmitting or broadcasting RF advertisement 222, much as discussed with respect to FIG. 3. Much as discussed with respect to FIGS. 3 and 4, wireless mobile device 230 is configured to detect or receive RF advertisement 222, such as during periods 234, and determine RSSI 260 for RF advertisement 222. Further, wireless mobile device 230 may determine whether RSSI 260 is greater than or equal to the third signal strength threshold 254, although in some implementations that comparison may be performed by another component included in access control system 100, such as access control server 110 or RF communication unit 214. In response to a determination that RSSI 260 is greater than or equal to the third signal strength threshold 254, wireless mobile device 230 may transmit a message, such like message 236, which may be obtained by RF communication unit 214 or access control server 110. RF communication unit 214 or access control server 110 may perform decryption and/or validation of message 236, and determine whether access should be granted to the secured area or resource controlled by access control device 210, much as discussed above with respect to FIGS. 4 and 5.

Figure 8:
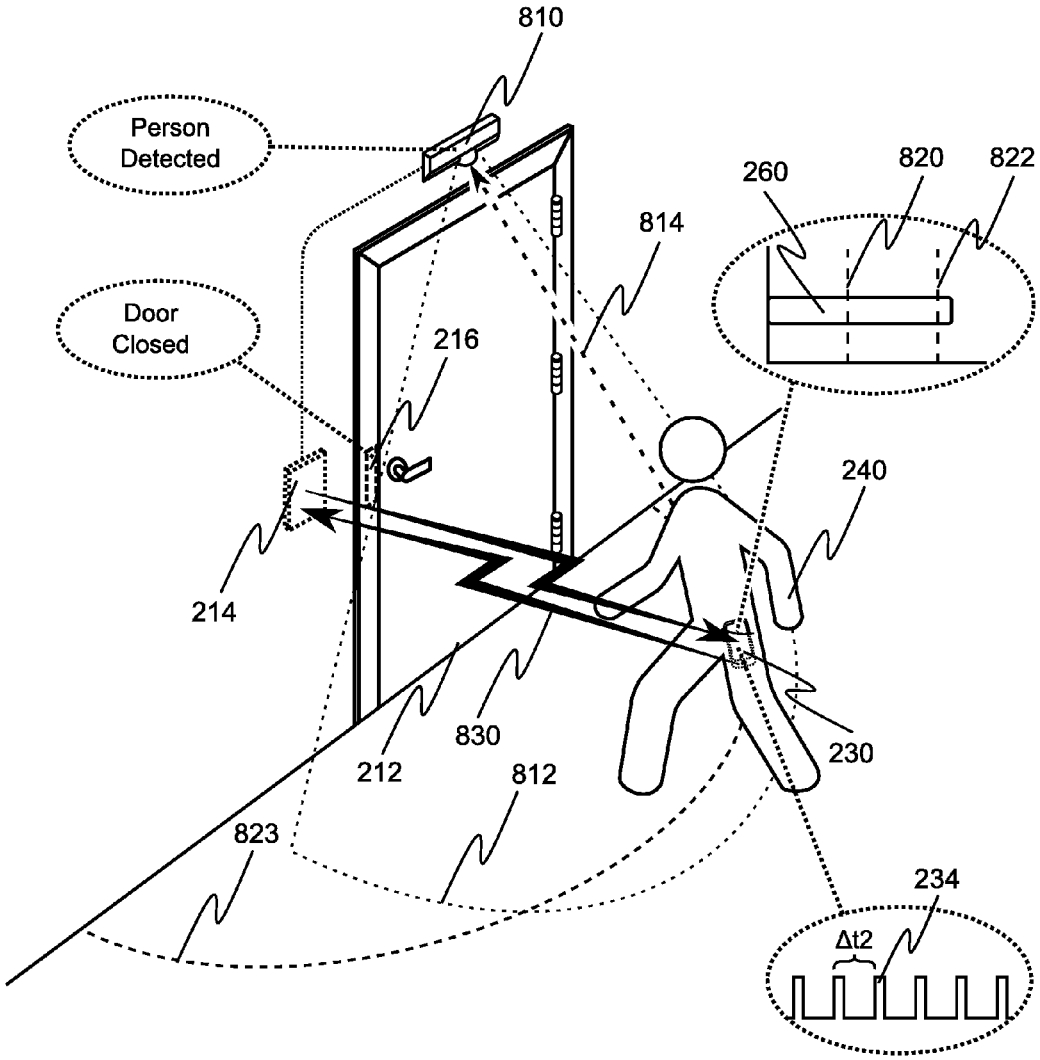
FIG. 8 illustrates an example of a user leaving a secured area controlled by a access control device.

FIG. 8 illustrates an example of a user leaving a secured area controlled by a access control device. In addition to secured door 212, RF communication unit 214, and lock 216, access control device 210 further includes a proximity detector 810, which is configured to detect the presence of a person, such as user 240, within a proximity detection region 812. In the example illustrated in FIG. 8, RSSI 260 for RF advertisement 222 from RF communication unit 214 (which in this example is on an opposite side of a wall) is equal to or greater than a first signal strength threshold 820 and is equal to or greater than a second signal strength threshold 822, where the second signal strength threshold 822 is greater than the first signal strength threshold 820. The second signal strength threshold 822 corresponds approximately to a distance from RF communication unit 214 illustrated by distance circle 823. Proximity detector 810 has received a proximity signal 814, in response to which proximity detector 810 may determine that a person, such as user 240, is present within proximity detection region 812. RF advertisement 222 may include information indicating that proximity detector 810 presently detects the presence of a person, and that secure door 212 is presently closed. Wireless mobile device 230 may be configured to transmit a message 830 to access control server 110 or RF communication unit in response to RF advertisement 222 indicating that a person is detected by proximity detector 810 and RSSI 260 being equal to or greater than second signal strength threshold 822.

Figure 9:
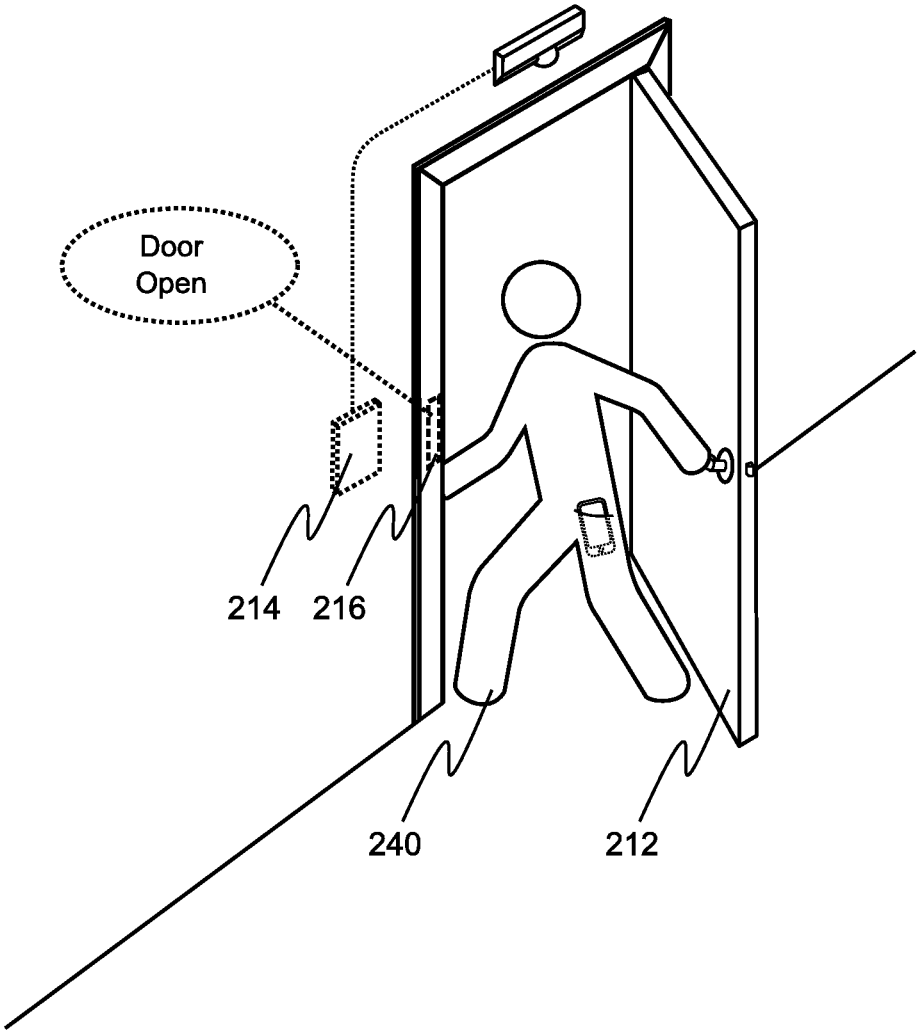
FIG. 9 illustrates an example that continues the example illustrated in FIG. 7.

FIG. 9 illustrates an example that continues the example illustrated in FIG. 7. In FIG. 9, user 240 has opened secured door 212, and is exiting the secured area controlled by access control device 210. Access control device 210 may be configured to determine that secured door 212 is open; for example, lock 216 may be capable of determining when secured door 212 is open or closed. Access control server 110 may obtain information, such as, but not limited to, information included in message 830, an indication that proximity sensor 810 detected a person, and/or indications of opening and closing of secured door 212, and access control server 110 may be configured to, based on this information, determine when user 240 has exited from the secured area controlled by access control device 210. This determination may further be based on records indicating user 240 having entered the secured area via access control device 210 of another access control device that also controls entry into the secured area. Access control server 110 may also be configured to record when user 240 enters and exits via access control devices 160.

Figure 10:
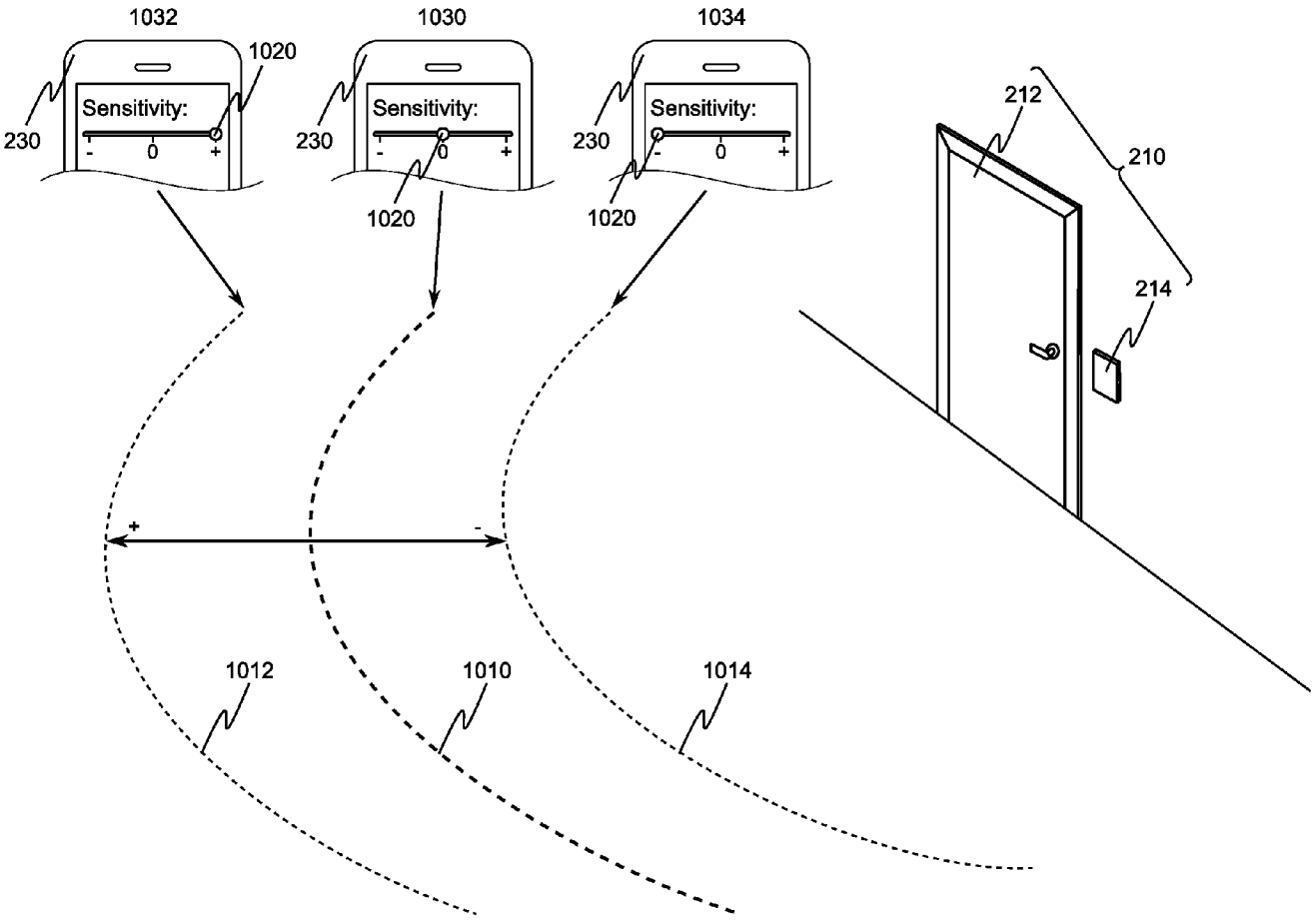
FIG. 10 illustrates an example of a user-specified sensitivity adjustment value and an associated user interface provided by a wireless mobile device.

FIG. 10 illustrates an example of a user-specified sensitivity adjustment value and an associated user interface provided by a wireless mobile device. A default distance circle 1010 illustrates a distance from access control device 210 or RF communication unit 214 included therein corresponding to a signal strength threshold, such as, for example, first signal strength threshold 220 illustrated in FIG. 2. In the example illustrated in FIG. 10, wireless mobile device 230 is configured to provide a graphical user interface for specifying a user-specified sensitivity adjustment value. The user-specified sensitivity adjustment value may be applied for all or a portion of access control devices 160 being managed by access control server 110. The user-specified sensitivity adjustment value may be applied only to an individual access control device, such as access control device 210. Although FIG. 10 illustrates an example of a graphical user interface provided by wireless mobile device 230, other techniques may be used to specify a user-specified sensitivity adjustment value, such as, but not limited to, push buttons on wireless mobile device 230 or via a website provided by access control server 110.

In view 1030 of wireless mobile device 230, a slider 1020 is set to a neutral or zero position, corresponding to either no user-specified sensitivity adjustment value or a user-specified sensitivity adjustment value of zero. The resulting distance at which an RSSI for an RF advertisement transmitted by access control device 210 is expected to be equal to the signal strength threshold is illustrated approximately by distance circle 1010. In view 1032 of wireless mobile device 230, the slider 1020 has been set to a maximum positive position, which increases the sensitivity of wireless mobile device to RF advertisements transmitted by access control device 210. The resulting distance at which an RSSI for an RF advertisement transmitted by access control device 210 is expected to be equal to the signal strength threshold when a corresponding user-specified sensitivity adjustment value is applied is illustrated approximately by distance circle 1012. As can be seen in FIG. 10, the resulting distance is closer to access control device 210 than when the slider 1020 is set to the neutral or zero position. In view 1034 of wireless mobile device 230, the slider 1020 has been set to a maximum negative position, which decreases the sensitivity of wireless mobile device 230 to RF advertisements transmitted by access control device 210. The resulting distance at which an RSSI for an RF advertisement transmitted by access control device 210 is expected to be equal to the signal strength threshold when a corresponding user-specified sensitivity adjustment value is applied is illustrated approximately by distance circle 1014. As can be seen in FIG. 10, the resulting distance is closer to access control device 210 than when the slider 1020 is set to the neutral or zero position.

As discussed previously, a user-specified sensitivity adjustment value may be specific to an individual access control device, or may be applied globally to all or a significant portion of access control devices 160 being managed by access control server 110. In some implementations, both global and device-specific user-specified sensitivity adjustment values may be specified and recorded. In the event that both user-specified sensitivity adjustment values may be applied to access control device 210, access control system 100 may be configured to apply the device-specific user-specified sensitivity adjustment value and not apply the global user-specified sensitivity adjustment value. The user-specified sensitivity adjustment values may be stored by access control server 110, which may also be configured to distribute the user-specified sensitivity adjustment values to access control devices 160 and wireless mobile devices 140*a*-140*e*.

It is noted that although FIGS. 2-10 discuss examples in which RF communication unit 210 is configured to operate in a BLE GAP Peripheral role and wireless mobile device 230 is configured to operate in a BLE GAP Common role, those roles may be reversed such that during some or all interactions between RF communication unit 210 and wireless mobile device 230, RF communication unit 210 is configured to operate in a BLE GAP Common role and wireless mobile device 230 is configured to operate in a BLE GAP Peripheral role. In some implementations, RF communication unit 210 and wireless mobile device 230 may each be selectively configured to operate in a BLE GAP Broadcaster role or BLE GAP Observer role, depending on whether their interactions involve transmitting or receiving RF advertisements or other data.

It is noted that although FIGS. 2-10 illustrate examples involving determining an RSSI for an RF signal, such as an RF advertisement, received at a wireless mobile device 230, and the use of RF messaging by wireless mobile device 230 and RF communication unit 210, in some implementations non-RF based techniques may be used to similar effect. For example, ultrasonic or infrasonic audio signaling may be used, as wireless mobile device 230 may include a microphone and/or a transducer effective for receiving and/or transmitting such audio signals. As with RF signals, an intensity of a received audio signal may be used in connection with thresholds to determine the proximity of wireless mobile device 230 to an access control device.

It is noted that although the above examples may be illustrated in terms of various operations being performed by certain components of access control system 100, this disclosure is not to be understood as limited to those particular illustrations. For many of the operations described above, the same or similar results may be obtained by performing the operations with other components than described, and with operations being divided into sub-operations of which some may be performed by components other than described. Such modifications to the examples discussed above remain within the scope of this disclosure.

The software functionalities involve programming, including executable code as well as associated stored data. The software code is executable by processing units included in wireless mobile devices 140*a*-140*e* and 230, access control server 110, and access control devices 160 and 210. In operation, the code is stored within these devices. At other times, however, the software may be stored at other locations and/or transported for loading into the appropriate devices. Execution of such code by the processing units included in access control system 100 enables the components of access control system 100 to implement the methodology for controlling access to secured areas and resources, in essentially the manner performed in the implementations discussed and illustrated herein.

Figure 11:
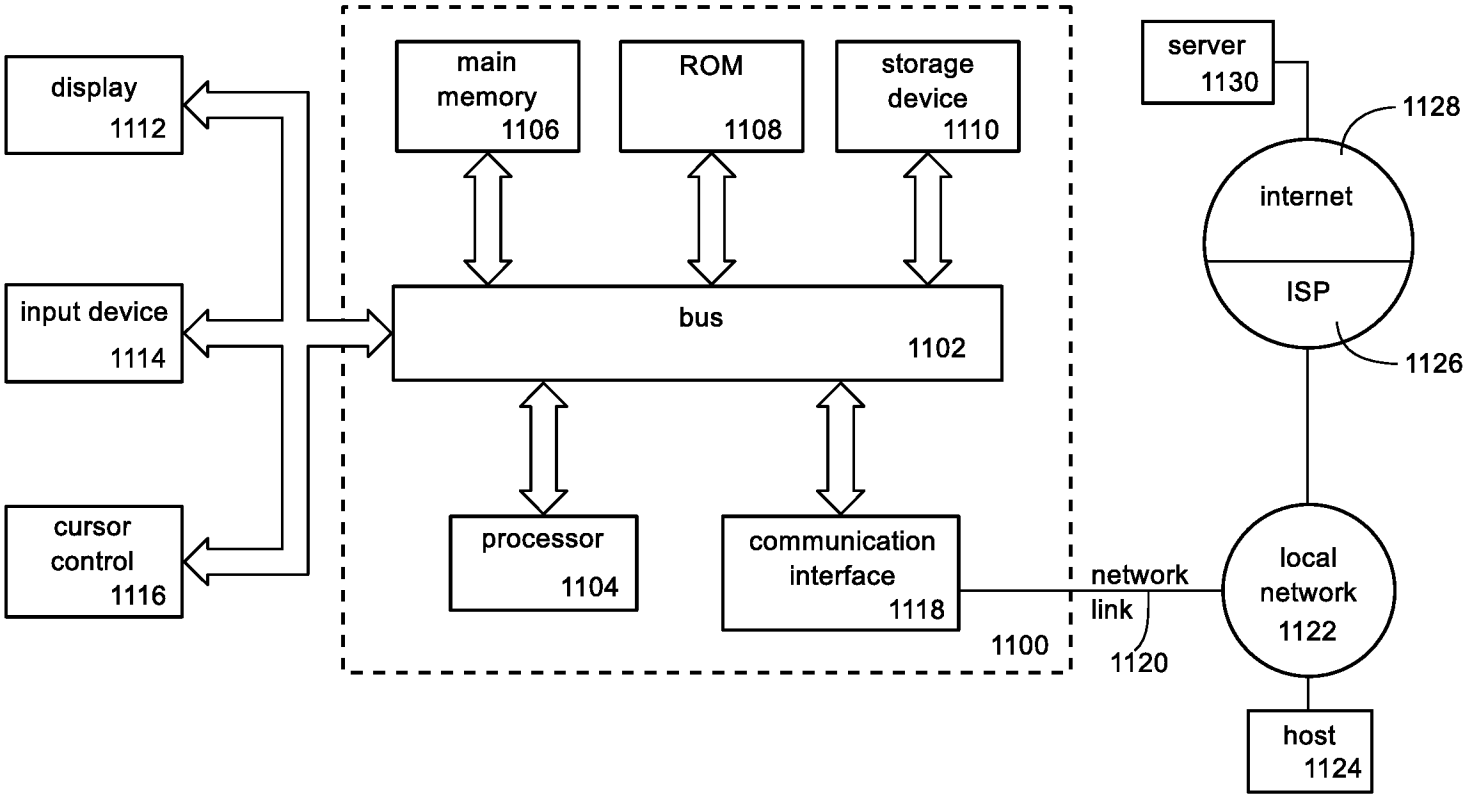
FIG. 11 is a block diagram that illustrates a computer system upon which aspects of this disclosure may be implemented detailed description.

FIG. 11 is a block diagram that illustrates a computer system 1100 upon which aspects of this disclosure may be implemented, such as, but not limited to wireless mobile devices 140*a*-140*e* and 230, access control server 110, access control devices 160 and 210, and RF communication units 167, 171, 173, and 214. Computer system 1100 includes a bus 1102 or other communication mechanism for communicating information, and a processor 1104 coupled with bus 1102 for processing information. Computer system 1100 also includes a main memory 1106, such as a random access memory (RAM) or other dynamic storage device, coupled to bus 1102 for storing information and instructions to be executed by processor 1104. Main memory 1106 also may be used for storing temporary variables or other intermediate information during execution of instructions to be executed by processor 1104. Computer system 1100 further includes a read only memory (ROM) 1108 or other static storage device coupled to bus 1102 for storing static information and instructions for processor 1104. A storage device 1110, such as a magnetic disk or optical disk, is provided and coupled to bus 1102 for storing information and instructions.

Computer system 1100 may be coupled via bus 1102 to a display 1112, such as a cathode ray tube (CRT) or liquid crystal display (LCD), for displaying information to a computer user. An input device 1114, including alphanumeric and other keys, is coupled to bus 1102 for communicating information and command selections to processor 1104. Another type of user input device is cursor control 1116, such as a mouse, a trackball, or cursor direction keys for communicating direction information and command selections to processor 1104 and for controlling cursor movement on display 1112. This input device typically has two degrees of freedom in two axes, a first axis (e.g., x) and a second axis (e.g., y), that allows the device to specify positions in a plane. Another type of user input device is a touchscreen, which generally combines display 1112 with hardware that registers touches upon display 1112.

This disclosure is related to the use of computer systems such as computer system 1100 for implementing the techniques described herein. In some examples, those techniques are performed by computer system 1100 in response to processor 1104 executing one or more sequences of one or more instructions contained in main memory 1106. Such instructions may be read into main memory 1106 from another machine-readable medium, such as storage device 1110. Execution of the sequences of instructions contained in main memory 1106 causes processor 1104 to perform the process steps described herein. In some examples, hardwired circuitry may be used in place of or in combination with software instructions to implement the various aspects of this disclosure. Thus, implementations are not limited to any specific combination of hardware circuitry and software.

The term "machine-readable medium" as used herein refers to any medium that participates in providing data that causes a machine to operation in a specific fashion. In some examples implemented using computer system 1100, various machine-readable media are involved, for example, in providing instructions to processor 1104 for execution. Such a medium may take many forms, including but not limited to, non-volatile media, volatile media, and transmission media. Non-volatile media includes, for example, optical or magnetic disks, such as storage device 1110. Volatile media includes dynamic memory, such as main memory 1106. Transmission media includes coaxial cables, copper wire and fiber optics, including the wires that comprise bus 1102. Transmission media can also take the form of acoustic or light waves, such as those generated during radio-wave and infra-red data communications. All such media must be tangible to enable the instructions carried by the media to be detected by a physical mechanism that reads the instructions into a machine.

Common forms of machine-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, and EPROM, a FLASH-EPROM, any other memory chip or cartridge, a carrier wave as described hereinafter, or any other medium from which a computer can read.

Various forms of machine-readable media may be involved in carrying one or more sequences of one or more instructions to processor 1104 for execution. For example, the instructions may initially be carried on a magnetic disk of a remote computer. The remote computer can load the instructions into its dynamic memory and send the instructions over a telephone line using a modem. A modem local to computer system 1100 can receive the data on the telephone line and use an infra-red transmitter to convert the data to an infra-red signal. An infra-red detector can receive the data carried in the infra-red signal and appropriate circuitry can place the data on bus 1102. Bus 1102 carries the data to main memory 1106, from which processor 1104 retrieves and executes the instructions. The instructions received by main memory 1106 may optionally be stored on storage device 1110 either before or after execution by processor 1104.

Computer system 1100 also includes a communication interface 1118 coupled to bus 1102. Communication interface 1118 provides a two-way data communication coupling to a network link 1120 that is connected to a local network 1122. For example, communication interface 1118 may be an integrated services digital network (ISDN) card or a modem to provide a data communication connection to a corresponding type of telephone line. As another example, communication interface 1118 may be a local area network (LAN) card to provide a data communication connection to a compatible LAN. Wireless links may also be implemented. In any such implementation, communication interface 1118 sends and receives electrical, electromagnetic or optical signals that carry digital data streams representing various types of information.

Network link 1120 typically provides data communication through one or more networks to other data devices. For example, network link 1120 may provide a connection through local network 1122 to a host computer 1124 or to data equipment operated by an Internet Service Provider (ISP) 1126. ISP 1126 in turn provides data communication services through the world wide packet data communication network now commonly referred to as the "Internet" 1128. Local network 1122 and Internet 1128 both use electrical, electromagnetic or optical signals that carry digital data streams. The signals through the various networks and the signals on network link 1120 and through communication interface 1118, which carry the digital data to and from computer system 1100, are exemplary forms of carrier waves transporting the information.

Computer system 1100 can send messages and receive data, including program code, through the network(s), network link 1120 and communication interface 1118. In the Internet example, a server 1130 might transmit a requested code for an application program through Internet 1128, ISP 1126, local network 1122 and communication interface 1118.

The received code may be executed by processor 1104 as it is received, and/or stored in storage device 1110, or other non-volatile storage for later execution. In this manner, computer system 1100 may obtain application code in the form of a carrier wave.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus the following claims are hereby incorporated into the Detailed Description, with each claim standing on its own as a separately claimed subject matter.

What is claimed is:

1. A method comprising:

receiving and storing a first signal strength threshold associated with obtaining access to a first access control device;

receiving and storing a second signal strength threshold associated with obtaining access to a second access control device, wherein the second access control device is different than the first access control device and the second signal strength threshold is different from the first signal strength threshold;

receiving a first RF advertisement from the first access control device;

obtaining a first received signal strength indication (RSSI) for the received first RF advertisement;

selecting the first signal strength threshold based on a determination that an RF advertisement received from the first access control device is associated with the first access control device;

determining that the first RSSI is greater than or equal to the selected first signal strength threshold;

transmitting, in response to the determination that the first RSSI is equal to or greater than the first signal strength threshold, a first RF message to indicate that a device that received the first RF advertisement is proximate to the first access control device;

receiving and storing a third signal strength threshold associated with obtaining access to the first access control device, the third signal strength threshold being lower than the first signal threshold;

receiving and storing a fourth signal strength threshold associated with obtaining access to the second access control device, the fourth signal strength threshold being lower than the second signal threshold and the fourth signal strength threshold being different than the third signal strength threshold;

scanning at a first scan rate for a second RF advertisement transmitted or broadcast by the first access control device;

receiving the second RF advertisement message from the first access control device;

obtaining a second RSSI for the second RF advertisement message;

selecting the third signal strength threshold based on a determination that an RF advertisement received from the first access control device is associated with the first access control device;

determining that the second RSSI is greater than or equal to the third signal strength threshold; and scanning, in response to the determination that the second RSSI is greater than or equal to the third signal strength threshold, at a second scan rate greater than the first scan rate for the first RF advertisement message.

2. The method of claim 1, further comprising:

receiving and storing a first encryption key associated with the first access control device;

receiving and storing a second encryption key associated with the second access control device, the second encryption key being different than the first encryption key;

selecting the first encryption key based on a determination that an RF advertisement received from the first access control device is associated with the first access control device; and encrypting one or more portions of the first RF message based on the selected first encryption key prior to the transmitting of the first RF message.

3. The method of claim 1, wherein the first RF message indicates an approximate time of its transmission.

4. The method of claim 1, further comprising:

providing a user interface for adjusting and storing a user-specified sensitivity adjustment value in association with the first access control device;

selecting the user-specified sensitivity adjustment value based on a determination that an RF advertisement received from the first access control device is associated with the first access control device; and adjusting the first RSSI or the first signal strength threshold based on the selected user-specified sensitivity adjustment value.

5. The method of claim 1, further comprising:

repeatedly transmitting a plurality of RF advertisements, including the first RF message, at a first amplitude, the plurality of RF advertisements indicating they are associated with the first access control device;

receiving the first RF message;

obtaining, after receiving the first RF message, an indication that a user has, at a distance of less than approximately 15 cm, come within range of a detector included in the first access control device; and granting, in response to receiving the first RF message and the obtained indication, access to a secured area or resource controlled by the first access control device.

6. A method comprising:

receiving and storing a first signal strength threshold associated with obtaining access to a first access control device;

receiving and storing a second signal strength threshold associated with obtaining access to a second access control device, wherein the second access control device is different than the first access control device and the second signal strength threshold is different from the first signal strength threshold;

receiving a first RF advertisement from the first access control device;

obtaining a first received signal strength indication (RSSI) for the received first RF advertisement;

selecting the first signal strength threshold based on a determination that an RF advertisement received from the first access control device is associated with the first access control device;

determining that the first RSSI is greater than or equal to the selected first signal strength threshold;

transmitting, in response to the determination that the first RSSI is equal to or greater than the first signal strength threshold, a first RF message to indicate that a device that received the first RF advertisement is proximate to the first access control device;

repeatedly transmitting a plurality of RF advertisements, including the first RF message, at a first amplitude, the plurality of RF advertisements indicating they are associated with the first access control device;

receiving the first RF message;

obtaining, after receiving the first RF message, an indication that a user has, at a distance of less than approximately 15 cm, come within range of a detector included in the first access control device;

granting, in response to receiving the first RF message and the obtained indication, access to a secured area or resource controlled by the first access control device;

presenting, in response to receiving the first RF message, a visual or auditory indication that a user is expected to interact with the first access control device at a distance of less than approximately 15 cm to obtain access to the secured area or resource.

7. The method of claim 6, further comprising:

capacitively sensing a portion of the user's body is at a distance of less than approximately 15 cm from the first access control device.

8. A nontransitory computer-readable medium including instructions which, when executed by one or more processors, cause the one or more processors to:

receive and store a first signal strength threshold associated with obtaining access to a first access control device;

receive and store a second signal strength threshold associated with obtaining access to a second access control device, wherein the second access control device is different than the first access control device and the second signal strength threshold is different from the first signal strength threshold;

receive a first RF advertisement from the first access control device;

obtain a first received signal strength indication (RSSI) for the received first RF advertisement;

select the first signal strength threshold based on a determination that an RF advertisement received from the first access control device is associated with the first access control device;

determine that the first RSSI is greater than or equal to the selected first signal strength threshold;

transmit, in response to the determination that the first RSSI is equal to or greater than the first signal strength threshold, a first RF message to indicate that a device that received the first RF advertisement is proximate to the first access control device;

receive and store a third signal strength threshold associated with obtaining access to the first access control device, the third signal strength threshold being lower than the first signal threshold;

receive and store a fourth signal strength threshold associated with obtaining access to the second access control device, the fourth signal strength threshold being lower than the second signal threshold and the fourth signal strength threshold being different than the third signal strength threshold;

scan at a first scan rate for a second RF advertisement transmitted or broadcast by the first access control device;

receive the second RF advertisement message from the first access control device;

obtain a second RSSI for the second RF advertisement message;

select the third signal strength threshold based on a determination determining that an RF advertisement received from the first access control device is associated with the first access control device;

determine that the second RSSI is greater than or equal to the third signal strength threshold; and scan, in response to the determination that the second RSSI is greater than or equal to the third signal strength threshold, at a second scan rate greater than the first scan rate for the first RF advertisement message.

9. The computer-readable medium of claim 8, wherein the instructions further cause the one or more processors to:

receive and store a first encryption key associated with the first access control device;

receive and store a second encryption key associated with the second access control device, the second encryption key being different than the first encryption key;

selecting the first encryption key based on a determination that an RF advertisement received from the first access control device is associated with the first access control device; and encrypt one or more portions of the first RF message based on the selected first encryption key prior to the transmitting of the first RF message.

10. The computer-readable medium of claim 8, wherein the first RF message indicates an approximate time of its transmission.

11. The computer-readable medium of claim 8, wherein the instructions further cause the one or more processors to:

provide a user interface for adjusting and storing a user-specified sensitivity adjustment value in association with the first access control device;

select the user-specified sensitivity adjustment value based on a determination that an RF advertisement received from the first access control device is associated with the first access control device; and adjust the first RSSI or the first signal strength threshold based on the selected user-specified sensitivity adjustment value.

12. The method of claim 1, further comprising:

receiving a third RF advertisement from the second access control device;

obtaining a third RSSI for the received third RF advertisement;

selecting the second signal strength threshold based on a determination that an RF advertisement received from the second access control device is associated with the second access control device;

determining that the third RSSI is greater than or equal to the selected second signal strength threshold; and transmitting, in response to the determination that the third RSSI is equal to or greater than the second signal strength threshold, a third RF message to indicate that a device that received the third RF advertisement is proximate to the second access control device.

13. The method of claim 12, wherein the first access control device includes a secured door controlling access to a secured area; and the method further includes:

receiving the first RF message, and unlocking the secured door in response to receiving the first RF message.

14. The method of claim 1, further comprising:

identifying a model of a wireless mobile device;

selecting or obtaining a model-specific sensitivity adjustment value based on the identified model; and adjusting the first RSSI or the first signal strength threshold based on the selected or obtained model-specific sensitivity adjustment value.

15. The computer-readable medium of claim 8, wherein the instructions further cause the one or more processors to:

receive a third RF advertisement from the second access control device;

obtain a third RSSI for the received third RF advertisement;

select the second signal strength threshold based on a determination that an RF advertisement received from the second access control device is associated with the second access control device;

determine that the third RSSI is greater than or equal to the selected second signal strength threshold; and transmit, in response to the determination that the third RSSI is equal to or greater than the second signal strength threshold, a third RF message to indicate that a device that received the third RF advertisement is proximate to the second access control device.

16. The computer-readable medium of claim 8, wherein the instructions further cause the one or more processors to:

identify a model of a wireless mobile device;

select or obtain a model-specific sensitivity adjustment value based on the identified model; and adjust the first RSSI or the first signal strength threshold based on the selected or obtained model-specific sensitivity adjustment value.

* * * * *